US006478491B2

(12) United States Patent
Nishimura et al.

(10) Patent No.: US 6,478,491 B2
(45) Date of Patent: Nov. 12, 2002

(54) IMAGE FORMING APPARATUS

(75) Inventors: Kazuhiro Nishimura, Tokyo (JP); Iwao Kawamura, Kanagawa (JP); Kiyokazu Namekata, Tokyo (JP); Kazuhiro Murakami, Tokyo (JP); Ryoma Suzuki, Tokyo (JP); Naoki Kiyohara, Tokyo (JP); Kensuke Izuma, Tokyo (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/767,198

(22) Filed: Jan. 22, 2001

(65) Prior Publication Data

US 2001/0005466 A1 Jun. 28, 2001

Related U.S. Application Data

(62) Division of application No. 09/142,005, filed as application No. PCT/JP97/00637 on Mar. 3, 1997, now Pat. No. 6,273,624.

(30) Foreign Application Priority Data

Mar. 4, 1996 (JP) ..... 8-045714
Mar. 4, 1996 (JP) ..... 8-046052
Aug. 26, 1996 (JP) ..... 8-223473

(51) Int. Cl.[7] ..... B41J 13/02
(52) U.S. Cl. ..... 400/637.1; 400/636; 400/639.2
(58) Field of Search ..... 400/636, 636.1, 400/624, 625, 637, 637.1, 639, 639.2, 645, 645.4; 271/273, 274; 347/215, 216

(56) References Cited

U.S. PATENT DOCUMENTS

| | | | | |
|---|---|---|---|---|
| 4,498,795 A | | 2/1985 | Tatara | |
| 4,518,271 A | * | 5/1985 | Hirata | 400/636.1 |
| 4,560,295 A | | 12/1985 | Fujiwara et al. | |
| 4,693,621 A | | 9/1987 | Kawaguchi | |
| 4,832,519 A | | 5/1989 | Fujimoto | |

FOREIGN PATENT DOCUMENTS

| | | |
|---|---|---|
| JP | 58-55023 | 4/1983 |
| JP | 59-79351 | 5/1984 |
| JP | 3-68444 | 3/1991 |
| JP | 7-53973 | 2/1995 |

* cited by examiner

*Primary Examiner*—Ren Yan
(74) *Attorney, Agent, or Firm*—Dellett and Walters

(57) ABSTRACT

An image forming apparatus having a print member for forming an image on a recording sheet while reciprocating in a predetermined direction includes a pair of conveyance rollers and a separating member for separating the of conveyance rollers from one another. A control lever for controlling the separating member is provided as is a changeover element for permitting the control lever to rotate when said print member moves in a predetermined direction and is not located at an interference area in which the print member would collide with the conveyance rollers if they were separated, and for prohibiting the control lever from rotating when the print member is located at the interference area.

3 Claims, 8 Drawing Sheets

IMAGE FORMING APPARATUS

This is a divisional of copending application Ser. No. 09/142,005, filed on Aug. 28, 1998, International Application PCT/JP97/00637 filed on Mar. 3, 1997, and which designated the U.S.

TECHNICAL FIELD

The present invention relates to an image forming apparatus in which a printing member for printing figures, characters, etc. is reciprocated in a predetermined direction to form an image on a recording sheet.

BACKGROUND ART

There is known, as one of output devices of computers and workstations, an image forming apparatus employing an ink-jet system in which ink is ejected to form an image on a recording sheet. The image forming apparatus employing an ink-jet system comprises, for example, a print head having a plurality of ink ejection outlets each for ejecting ink, a carriage on which the print head is mounted, said carriage reciprocating in a predetermined direction, and a conveying device for intermittently conveying recording sheets in a direction (a recording sheet conveying direction) intersecting perpendicularly to the predetermined direction.

In the event that an image is recorded on a recording sheet, the recording sheet in the course of conveyance by the conveying device is temporarily stopped, and while the carriage is reciprocated in the predetermined direction, ink is ejected from the ink ejection outlets in accordance with a control of the print head to form (print) a band of image on a portion located at an image formation area of the recording sheet. Thereafter, the recording sheet is fed by a predetermined length to form an image on a new portion located at the image formation area, of the recording sheet. Such a performance is repeated.

The conveying device comprises, usually, a drive roller having a drive roller axle extending in a direction intersecting perpendicularly to the recording sheet conveying direction, and a plurality of driven rollers each detachably mounted on the drive roller for pressing the outer peripheral surface of the drive roller. The drive roller and the driven rollers support a recording sheet in cooperation with one another and convey the recording sheet to the image formation area in such a manner that the recording sheet is sticked on the outer peripheral surface of the drive roller.

In the course of conveyance of the recording sheet in this manner, it happens that a jam occurs for example, around the drive roller. In case of the occurrence of the jam, there is a need to remove the recording sheet by separating the driven rollers from the drive roller. It happens, however, that a movable distance of the driven rollers for separation from the drive roller is too short to access the place at which the jam has occurred. Further, even if it is accessible, it happens that the recording sheet is broken because of insufficient grasp for the recording sheet. Consequently, in some cases, it would take a long time to solve the jam.

After solving the jam, the drive roller is pressed by the driven rollers and the recording sheet is conveyed while supported by the drive roller and the driven rollers. In this case, it happens that the driven rollers are out of their regular positions. In such a case, it happens that rotating the drive roller in some turns causes the driven rollers to take to the drive roller so that the driven rollers are regulated in their positions. However, in this case, it happens that the recording sheet is not conveyed in a proper conveyance direction during a period of time until the driven rollers have been regulated in their positions. Thus, there is a possibility that the jam again occurs.

Further, when the jam occurs, it happens that the carriage stops upward the driven rollers. In such a situation, when the driven rollers are separated from the drive roller so as to remove the recording sheet, there is a possibility that the driven rollers collide with the carriage or the print head which is mounted on the carriage, and as a result they are damaged.

DISCLOSURE OF THE INVENTION

In view of the foregoing, it is an object of the present invention is to provide an image forming apparatus capable of readily removing, when a jam occurs, a recording sheet which undergoes the jam.

The present invention has been made to attain the above-mentioned object and is to provide a first image forming apparatus in which a recording sheet is conveyed in a predetermined recording sheet conveyance direction, and an image is formed on a portion of the conveying recording sheet, said portion being located at an image forming area for forming images, said image forming apparatus comprising:

(1) a drive roller, having a drive roller axle extending in a direction intersecting said predetermined recording sheet conveyance direction, for rotating on said drive roller axle to convey recording sheets to said image forming area;

(2) a first shaft rotatably fixed on a main frame of the apparatus, extending in parallel to said drive roller axle at a position apart from said drive roller;

(3) a driven roller for supporting and conveying a recording sheet between said drive roller and said driven roller by pressing an outer peripheral surface of said drive roller, said driven roller being separated from the outer peripheral surface by rotating on said first shaft in cooperation with a rotation of said first shaft;

(4) a discharge roller, having a discharge roller axle extending in a direction intersecting said predetermined recording sheet conveyance direction, for rotating on said discharge roller axle to discharge recording sheets, said discharge roller being arranged at downward stream end with respect to the recording sheet conveyance direction as compared with said image forming area;

(5) a second shaft rotatably fixed on the main frame of the apparatus, extending in parallel to said discharge roller axle at a position apart from said discharge roller;

(6) a driven discharge roller for supporting and discharging a recording sheet between said driven discharge roller and said discharge roller by pressing an outer peripheral surface of said discharge roller, said driven roller being separated from the outer peripheral surface by rotating on said second shaft in cooperation with a rotation of said second shaft; and (7) a control lever rotatable in a predetermined direction for rotating both said first and second shafts in cooperation with a rotation of said control lever in the predetermined direction, wherein said driven roller comprises:

a first driven roller for pressing the outer peripheral surface of said drive roller; and a second driven roller for pressing a surface, of the outer peripheral surface of said drive roller, which surface is different from a surface, of the outer peripheral surface of said drive roller, pressed by said first driven roller, and wherein said image forming apparatus further comprising:

a first lever of which the tip portion said first driven roller is rotatably fixed on, said first lever being rotatable on its rear portion in a first detachable direction in which said first driven roller is attachable and detachable to and from the outer peripheral surface of said drive roller; and a second lever of which the center portion said second driven roller is rotatably fixed on, the tip portion of said second lever being located in the vicinity of said first lever, said second lever being rotatable on its rear portion in a second detachable direction in which said second driven roller is attachable and detachable to and from the outer peripheral surface of said drive roller, wherein said second lever is rotated so as to separate said second driven roller from the outer peripheral surface of said drive roller through pressing the tip portion of said second lever by said first lever when said first lever rotates so that said first driven roller separates from the outer peripheral surface of said drive roller.

In the image forming apparatus as mentioned above, said driven roller comprises:

(8) a first driven roller for pressing the outer peripheral surface of said drive roller within a range between two straight lines which incline by 45° to a rotational direction of said drive roller and a reverse direction opposite to the rotational direction, respectively, with respect to a Y axis perpendicularly intersecting said drive roller axle; and a second driven roller for pressing the outer peripheral surface of said drive roller within a range between two straight lines which incline by 45° to the rotational direction of said drive roller and the reverse direction opposite to the rotational direction, respectively, with respect to an X axis perpendicularly intersecting said drive roller axle and the Y axis, (9) wherein said image forming apparatus further comprises:

a first lever extending along the X axis, said first lever being rotatable in a first detachable direction in which said first driven roller is attachable and detachable to and from the outer peripheral surface of said drive roller, wherein said first driven roller is rotatably fixed on said first lever; and a second lever extending along the Y axis, said second lever being rotatable in a second detachable direction in which said second driven roller is attachable and detachable to and from the outer peripheral surface of said drive roller, wherein said second driven roller is rotatably fixed on said second lever, and

(10) wherein it is acceptable that said first shaft comprises:

a first lever shaft for rotatably fixing said first lever in the first detachable direction; and a second lever shaft for rotatably fixing said second lever in the second detachable direction.

Further, it is acceptable that

(11) said first lever rotates in the first detachable direction in cooperation with a rotation of said control lever, and

(12) said second lever rotates in the second detachable direction in cooperation with a rotation of said first lever.

Furthermore, it is acceptable that

(13) said second shaft is disposed at a downward stream end with respect to the recording sheet conveyance direction as compared with said driven discharge roller.

In order to accomplish the above-mentioned object, there is provided a second image forming apparatus having recording sheet conveyance means for conveying recording sheets to an image forming area for forming images, wherein an image is formed on a recording sheet conveyed by said recording sheet conveyance means to the image forming area, said recording sheet conveyance means comprises:

(14) a drive roller rotatable on a drive roller axle extending in a direction intersecting a recording sheet conveyance direction;

(15) a first lever extending along an X axis perpendicularly intersecting said drive roller axle, said first lever being rotatable on a first lever shaft separated from said drive roller in such a manner that said first lever is attachable and detachable to and from an outer peripheral surface of said drive roller;

(16) a second lever extending along a Y axis perpendicularly intersecting both said drive roller axle and said X axis, said second lever being rotatable on a second lever shaft separated from said drive roller in such a manner that said second lever is attachable and detachable to and from the outer peripheral surface of said drive roller;

(17) a first driven roller rotatably fixed on said first lever, said first driven roller supporting the recording sheet between it and said drive roller through pressing the outer peripheral surface of said drive roller when said first lever is in contact with the outer peripheral surface of said drive roller, and said first driven roller separating from the outer peripheral surface of said drive roller when said first lever separates from the outer peripheral surface of said drive roller; and

(18) a second driven roller rotatably fixed on said second lever, said second driven roller supporting the recording sheet between it and said drive roller through pressing the outer peripheral surface of said drive roller when said second lever is in contact with the outer peripheral surface of said drive roller, and said second driven roller separating from the outer peripheral surface of said drive roller when said second lever separates from the outer peripheral surface of said drive roller,

(19) wherein said first lever has a slide cam shaft penetrating in a direction intersecting a rotational direction of the first lever at a position separating from said first lever shaft; and

(20) said second lever has a slide cam for separating said first lever from said drive roller through pushing said slide cam shaft when said second lever separates from the outer peripheral surface of said drive roller, and

(21) wherein it is acceptable that said image forming apparatus comprises a control lever for rotating said second lever by rotating itself in a predetermined direction, and that said first lever is rotated so as to separate said first driven roller from the outer peripheral surface of said drive roller through pressing the first lever by said second lever when said second lever rotates so that said second driven roller separates from the outer peripheral surface of said drive roller.

(22) Further, it is acceptable that said slide cam shaft separates from said slide cam, when said first and second driven rollers press the outer peripheral surface of said drive roller.

In order to accomplish the above-mentioned object, there is provided a third image forming apparatus having a print member for forming an image on a recording sheet while reciprocating in a predetermined direction, and a plurality of sets of pair of conveyance rollers for supporting and conveying recording sheets in a direction intersecting said predetermined direction, wherein said plurality of sets of pair of conveyance rollers are used to convey a recording sheet to an image forming area for an image formation within a range of a reciprocation of said print member, and an image is formed on the recording sheet by said print member, said image forming apparatus comprises:

(23) a separating member for separating said pair of conveyance rollers from one another;

(24) a control lever for controlling said separating member through rotating in a predetermined rotational direction so that said pair of conveyance rollers are separated from one another; and

(25) a changeover element for permitting said control lever to rotate when said print member moves in the predetermined direction and is not located at an interference area in which said print member collides with the conveyance rollers separated by said separating member, and for prohibiting said control lever from rotating when said print member is located at the interference area.

In the image forming apparatus as mentioned above,

(26) it is acceptable that the apparatus further comprises a rotary cam rotatable together with said control lever,

(27) wherein said changeover element permits said control lever to rotate by separating from said rotary cam when said print member is located at a home position away from said image forming area, and for prohibiting said control lever from rotating by being in contact with said rotary cam.

Further, in the image forming apparatus as mentioned above,

(28) it is acceptable that the apparatus further comprises a control lever shaft rotatable together with said control lever, and

(29) a lever shaft on which said rotary cam is fixed, said lever shaft being coupled with said control lever shaft and rotatable together with said control lever shaft.

BEST MODE FOR CARRYING OUT THE INVENTION

Figure 1:
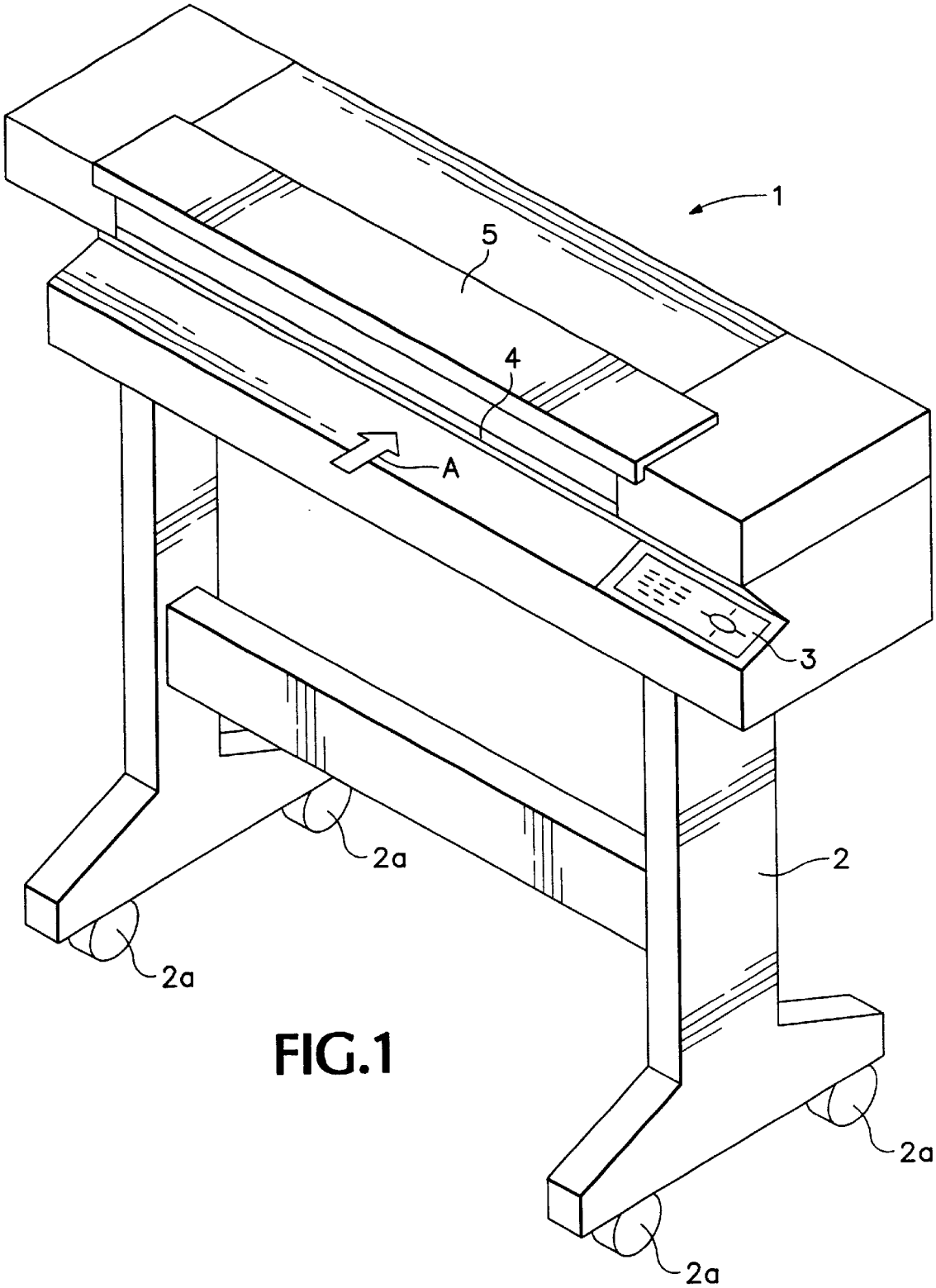
FIG. 1 is a perspective view showing a schematic construction of a color plotter according to an image forming apparatus of the present invention.

Hereinafter, embodiments of an image forming apparatus of the present invention will be described with reference to the drawing.

FIG. 1 is a perspective view showing a schematic construction of a color plotter (hereinafter, it will be referred to as a plotter) according to an example of an image forming apparatus of the present invention.

A plotter 1 is fixed on the top of a stand 2 equipped with casters 2*a*. The plotter 1 has a final control element 3 for operating the plotter 1. Operating various types of switches and the like provided on the final control element 3 permits instructions for a sheet type, on-line/off-line, a command, etc.

A recording sheet, which is inserted into a recording sheet insertion inlet 4 from an arrow A direction, is conveyed into the inside of the plotter 1 in accordance with an instruction inputted through the final control element 3, and is discharged after printing for a color image. The plotter 1 has also a cover 5 for covering the inside of the plotter 1. Opening the cover 5 makes it possible to see the inside of the plotter 1 and also to operate a control lever which will be described later.

Next, there will be described a conveyance path for recording sheets and a print (image forming) process with reference to FIG. 2.

The plotter 1 may perform a printing selectively either on a recording sheet inserted from the recording sheet insertion inlet 4 and a recording sheet (a rolled sheet 6) wound as a roll. Here, there will be described a conveyance path for recording sheets inserted from the recording sheet insertion inlet 4.

A recording sheet (for example, a large-sized cut sheet) is regularly placed on a cover 7 for the rolled sheet 6 and is inserted into the recording sheet insertion inlet 4 from an arrow A direction. The recording sheet thus inserted passes between the cover 7 and an upper guide 8, and reaches the upper portion (an example of an image forming area referred to in the present invention) of a print board 14, while being supported by both a sheet conveyance roller 10*a* (an example of the second driven roller referred to in the present invention, and also an example of one of a pair of conveyance rollers referred to in the present invention) rotatably fixed on a lower conveyance roller supporting plate 9 (an example of the second lever referred to in the present invention) and a sheet conveyance roller 10*b* (an example of the first driven roller referred to in the present invention, and also an example of another of a pair of conveyance rollers referred to in the present invention) rotatably fixed on an upper conveyance roller supporting plate 11 (an example of the first lever referred to in the present invention), and a drive roller 12. The recording sheet, which has passed through the upper portion of the print board 14, is discharged while being supported by a discharge roller 20 and spurs 22 (the discharge roller 20 and the spurs 22 are an example of a driven discharge roller referred to in the present invention). The spurs 22 are rotatably fixed on a spur plate 21.

The plotter 1 has a carriage 16 which reciprocates in an arrow B direction. The carriage 16 has a head holder 18 on which a plurality (four) of print heads 19 accommodating color inks (for example, cyan, magenta, yellow and black of inks), respectively, are mounted. The carriage 16 is fixed on a belt 17 which is coupled with a driving source (not illustrated) for a motor. The belt 17 reciprocates in an arrow B direction in accordance with a forward-backward rotation of the driving source. Reciprocation of the belt 17 in the arrow B direction causes the carriage 16 to reciprocate in the arrow B direction in accordance with a guide rail 18.

A recording sheet is intermittently conveyed in a direction (an example of a recording sheet conveyance direction) perpendicularly intersecting to the arrow B direction. When an image is formed on the recording sheet, the recording sheet is temporarily stopped, and while the carriage 16 reciprocates in the arrow B direction, ink is ejected in accordance with image information applied to the print heads 19 onto a portion, of the recording sheet, which portion is located at an image forming area. Thereafter, the recording sheet is conveyed by a predetermined length so that a subsequent band of image is formed on a new portion of the recording sheet, which is located at the image forming area. This operation is repeated throughout the overall length of the recording sheet. Thus, a color image is formed on the recording sheet. The recording sheet on which the color image is formed is discharged along a discharge guide 23 while being supported by the discharge roller 20 and the spurs 22.

Next, there will be described in detail part of the features of the plotter 1 with reference to FIG. 3.

As mentioned above, according to the plotter 1, it is possible not only to insert a sheet-like shaped recording paper from the arrow A direction, but also to insert a roll-like shaped recording paper 6 (cf. FIG. 2) from the arrow A' direction. The drive roller 12 has a drive roller axle 24, which perpendicularly intersects a recording sheet conveyance direction (arrows A, A' directions), and rotates on the drive roller axle 24 in an arrow C direction. A lower conveyance shaft supporting plate 26 is fixed on a main frame 25 (an example of an apparatus main frame referred to in the present invention) of the plotter 1. A lower conveyance shaft 27 (an example of the second lever shaft) is rotatably fixed on the lower conveyance shaft supporting plate 26.

The lower conveyance shaft 27 extends in parallel to the drive roller axle 24 at a position apart from the drive roller 12. A lower conveyance roller supporting plate 9 is rotatably fixed on the lower conveyance shaft 27. The sheet conveyance roller 10*a* is rotatably fixed on the lower conveyance roller supporting plate 9 as mentioned above. Connected to a portion 9*a* of the lower conveyance roller supporting plate 9, which is located below the lower conveyance shaft 27, is one end of a coil spring 28. On the other hand, another end of the coil spring 28 is connected to the main frame 25. Consequently, the sheet conveyance roller 10*a* is actuated in the opposite direction to an arrow D direction (the arrow D direction and the opposite direction are an example of the second detachable direction referred to in the present invention) so as to press the outer peripheral surface 12*a* of the drive roller 12.

The upper conveyance roller supporting plate 29 is fixed on the main frame 25. An upper conveyance shaft 30 (an example of the first lever shaft) is rotatably fixed on the upper conveyance shaft supporting plate 29. The upper conveyance shaft 30 extends in parallel to the drive roller axle 24 at a position apart from the drive roller 12. An upper conveyance roller supporting plate 11 is rotatably fixed on the upper conveyance shaft 30.

The sheet conveyance roller 10*b* is rotatably fixed on the upper conveyance roller supporting plate 11 as mentioned above. A cam lever 31, which extends at the opposite side to the upper conveyance shaft 30, is fixed through the upper conveyance shaft 30 on the upper conveyance roller supporting plate 11 in one united body. Connected to a tip portion of the cam lever 31 is one end of a coil spring 32. On the other hand, another end of the coil spring 32 is connected to the main frame 25. Consequently, the sheet conveyance roller 10*b* is actuated in the opposite direction to an arrow E direction (the arrow E direction and the opposite direction are an example of the first detachable direction referred to in the present invention) so as to press the outer peripheral surface 12*a* of the drive roller 12.

In this manner, the sheet conveyance rollers 10*a* and 10*b* press the outer peripheral surface 12*a* of the drive roller 12. Thus, a rotation of the drive roller 12 makes it possible to convey a recording sheet in a conveyance direction while the recording sheet is guided by a guide element 33 of the lower conveyance roller supporting plate 9 and a guide element 34 of the upper conveyance roller supporting plate 11.

Again referring to FIG. 3 there will be explained a processing in a case where a jam occurs at the periphery of the drive roller 12.

A cam shaft mounting plate 35 is fixed on the main frame 25. A cam shaft 36 is rotatably fixed on the cam shaft mounting plate 35. A cam 37 is rotatably fixed on the cam shaft 36. As the cam 37 rotates in an arrow F direction, the cam lever 31, which is fixed on the upper conveyance roller supporting plate 11, also rotates in the arrow F direction. Since the sheet conveyance roller 10*b* is located at the opposite side to the cam lever 31 with respect to the upper conveyance shaft 30, the sheet conveyance roller 10*b* moves in the arrow E direction, so that it separates from the outer peripheral surface 12*a* of the drive roller 12.

A slide cam shaft 38 is fixed on the upper end portion of the lower conveyance roller supporting plate 9. The slide cam shaft 38 moves toward the upper conveyance shaft 30, as the upper conveyance roller supporting plate 11 rotates in the arrow E direction, while the slide cam shaft 38 is in contact with a slide cam 39 to be pressed thereby. Thus, the lower conveyance roller supporting plate 9 moves in the arrow D direction so that the sheet conveyance roller 10*a* separates from the outer peripheral surface 12*a* of the drive roller 12. In this manner, when the cam 37 rotates in the arrow F direction, the upper conveyance roller supporting plate 11 rotates as shown by a two-dot chain line so that the slide cam shaft 38 translates the slide cam 39. Further, the lower conveyance roller supporting plate 9 also rotates as shown by a two-dot chain line, and thus both the sheet conveyance roller 10*a* fixed on the lower conveyance roller supporting plate 9 and the sheet conveyance roller 10*b* fixed on the upper conveyance roller supporting plate 11 separate from the drive roller 12.

On the other hand, as mentioned above, the spur 22 is disposed above the discharge roller 20. The spur 22 is rotatably fixed on a spur plate 21 which is fixed on a spur shaft 40 (an example of the second shaft referred to in the present invention). The spur plate 21 is parallel to the drive roller axle 24 and is disposed at the downward stream end with respect to the recording sheet conveyance direction as compared with the spur 22. The spur shaft 40 rotates in an arrow G direction by an operation of the control lever 41 (cf. FIG. 2) as will be described later. As a result, the spur 22 separates from the discharge roller 20, and the spur plate 21 opens looking toward the upward stream end with respect to the recording sheet conveyance direction.

Incidentally, the control lever 41 is disposed at a position which involves no obstacle to conveyance of recording sheets. There is a need to open the cover 5 to operate the control lever 41. When the control lever 41 rotates in an arrow H direction (cf. FIG. 2), as mentioned above the sheet conveyance rollers 10*a* and 10*b* separate from the drive roller 12, and in addition the spur 22 separates from the discharge roller 20. This makes it easy to perform a jam processing.

As explained above, when the cam 37 rotates in the arrow F direction, the sheet conveyance rollers 10*a* and 10*b*, the guide elements 33 and 34, etc. rotate on the lower conveyance shaft 27 and the upper conveyance shaft 30 to separate from the drive roller 12. Thus, it is possible to more readily process the jam occurred around the drive roller 12.

Further, even if a jam occurs on a recording sheet conveyed at the downward stream end with respect to the recording sheet conveyance direction as compared with the drive roller 12, the spur plate 21 faces the upward stream end with respect to the recording sheet conveyance direction and opens in synchronism with the sheet conveyance rollers 10*a* and 10*b*, etc. Thus, it is possible to more readily process the jam.

Further, according to the present embodiment, the lower conveyance shaft 27 is fixed through the lower conveyance shaft supporting plate 26 on main frame 25, and the sheet conveyance roller 10*a* is fixed on the lower conveyance roller supporting plate 9 fixed on the lower conveyance shaft 27. Consequently, a parallel relation between the sheet conveyance roller 10*a* and the drive roller axle 24 is always constant. This feature makes it possible to immediately put the sheet conveyance roller 10*a* separated from the drive roller 12 back in its place on the outer peripheral surface 12*a* of the drive roller 12, and thereby conveying the recording sheet in the proper conveyance direction. This is the similar as to the matter of the sheet conveyance roller 10*b*.

Figure 4:
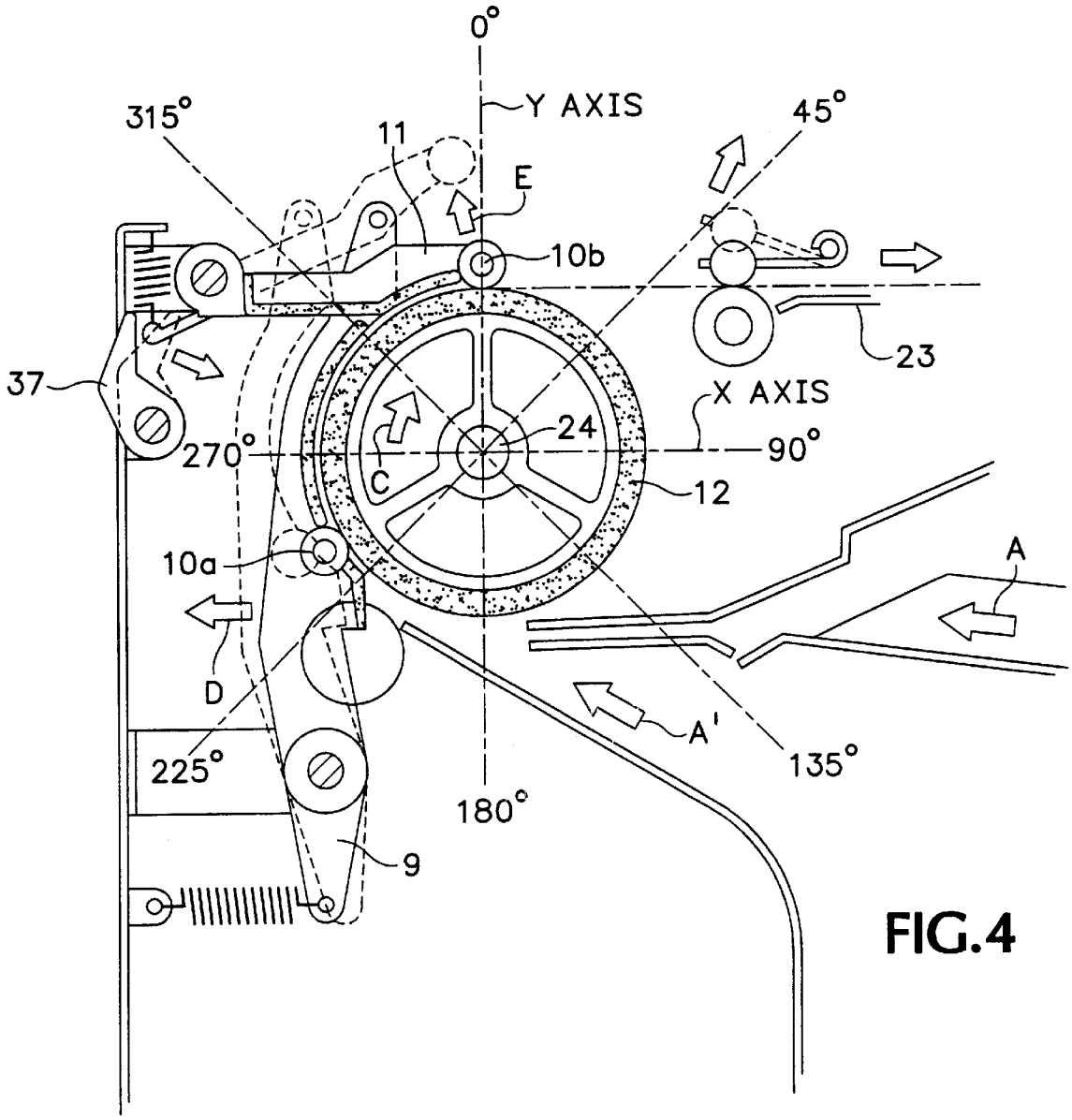
FIG. 4 is a typical illustration showing a positional relation between the drive roller and sheet conveyance rollers.

Next, there will be a positional relation between the drive roller 12 and the sheet conveyance rollers 10*a*, 10*b* with reference to FIG. 4.

In order to effectively perform such operations that the sheet conveyance rollers 10*a* and 10*b* are separated from the drive roller 12, and the drive roller 12 is pressed by the sheet conveyance rollers 10*a* and 10*b*, and in addition in order to make the jam processing easy, there is a need to dispose the drive roller 12 and the sheet conveyance rollers 10*a*, 10*b* at predetermined positions, respectively. Here, let us suppose that there are given a Y axis (here, by way of example, there is shown an axis passing through the center of the drive roller axle and extending vertically) perpendicularly intersecting the drive roller axle 24, and an X axis (here, by way of example, there is shown an axis passing through the center of the drive roller axle horizontally) perpendicularly intersecting both the drive roller axle 24 and the Y axis. Further, let us suppose that there are given, taking the Y axis as the basic line, straight lines inclined by 45°, 90°, 135°, 180°, 225°, 275° and 315° in a clockwise direction (a rotational direction of the drive roller 12, or the arrow C direction), respectively.

In order to implement the above-mentioned effective performance, of those straight lines, as to the ranges among the 315° inclined straight line, the Y axis and the 45° inclined straight line, the sheet conveyance roller 10*b* is translated in the Y axis direction. Further, with respect to the ranges among the 225° inclined straight line, the X axis (the 270° inclined straight line), and the 315° inclined straight line, the sheet conveyance roller 10*a* is translated in the X axis direction. In order to permit the translation of the sheet conveyance rollers 10*a* and 10*b* in those directions, according to the plotter 1, there is provided such an arrangement that the lower conveyance roller supporting plate 9 extends in the Y axis direction, and the the upper conveyance roller supporting plate 11 extends in the X axis direction.

Next, referring to FIG. 5 there will be explained the state in which the cam shaft 36 and the spur shaft 40 rotate in cooperation with the rotation of the control lever 41 in the arrow H direction.

Figure 2:
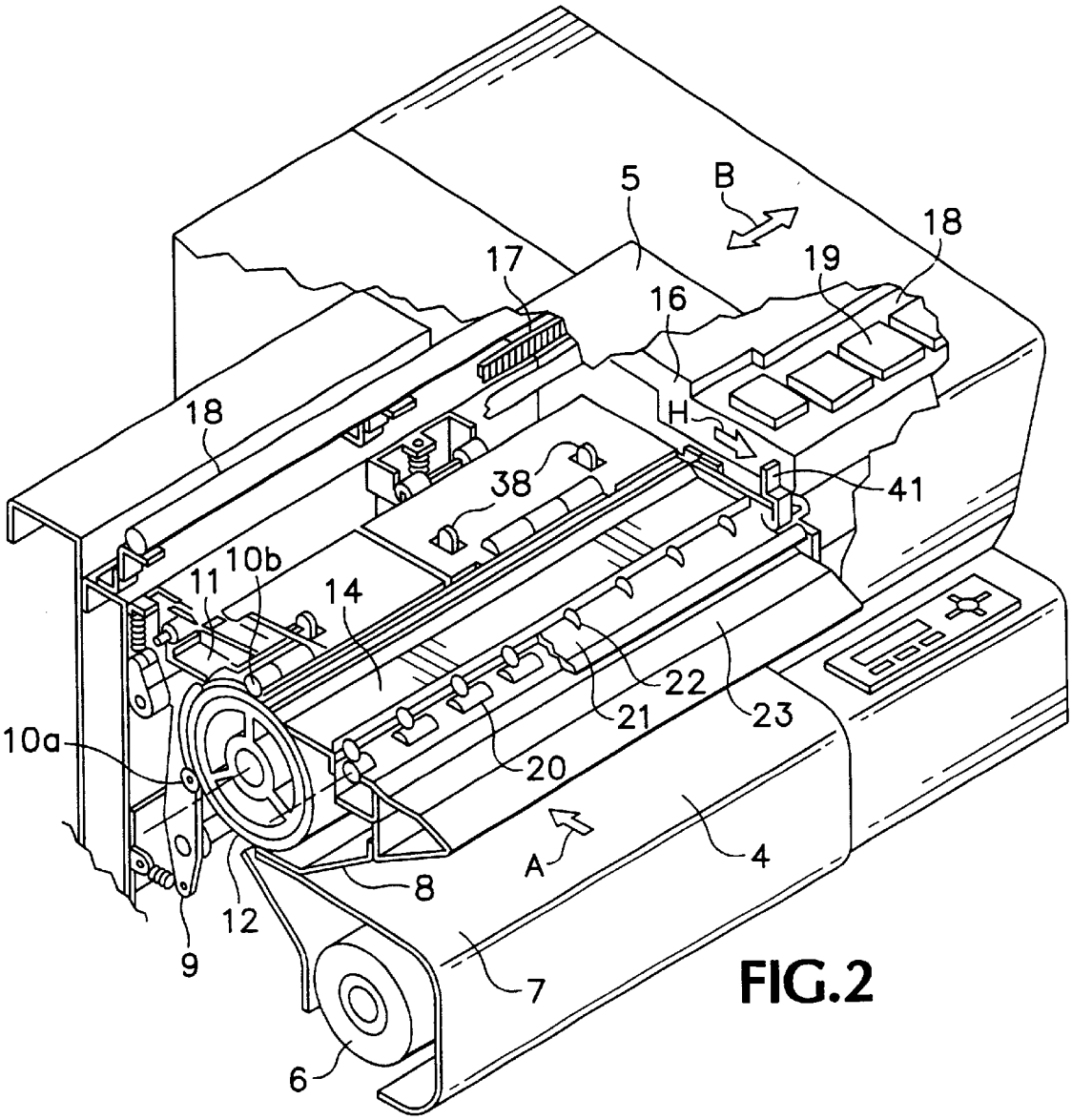
FIG. 2 is a perspective view of a path from an insertion of a recording sheet to a discharge of the recording sheet in the color plotter shown in FIG. 1, in which the color plotter is shown on an open basis.
Figure 5:
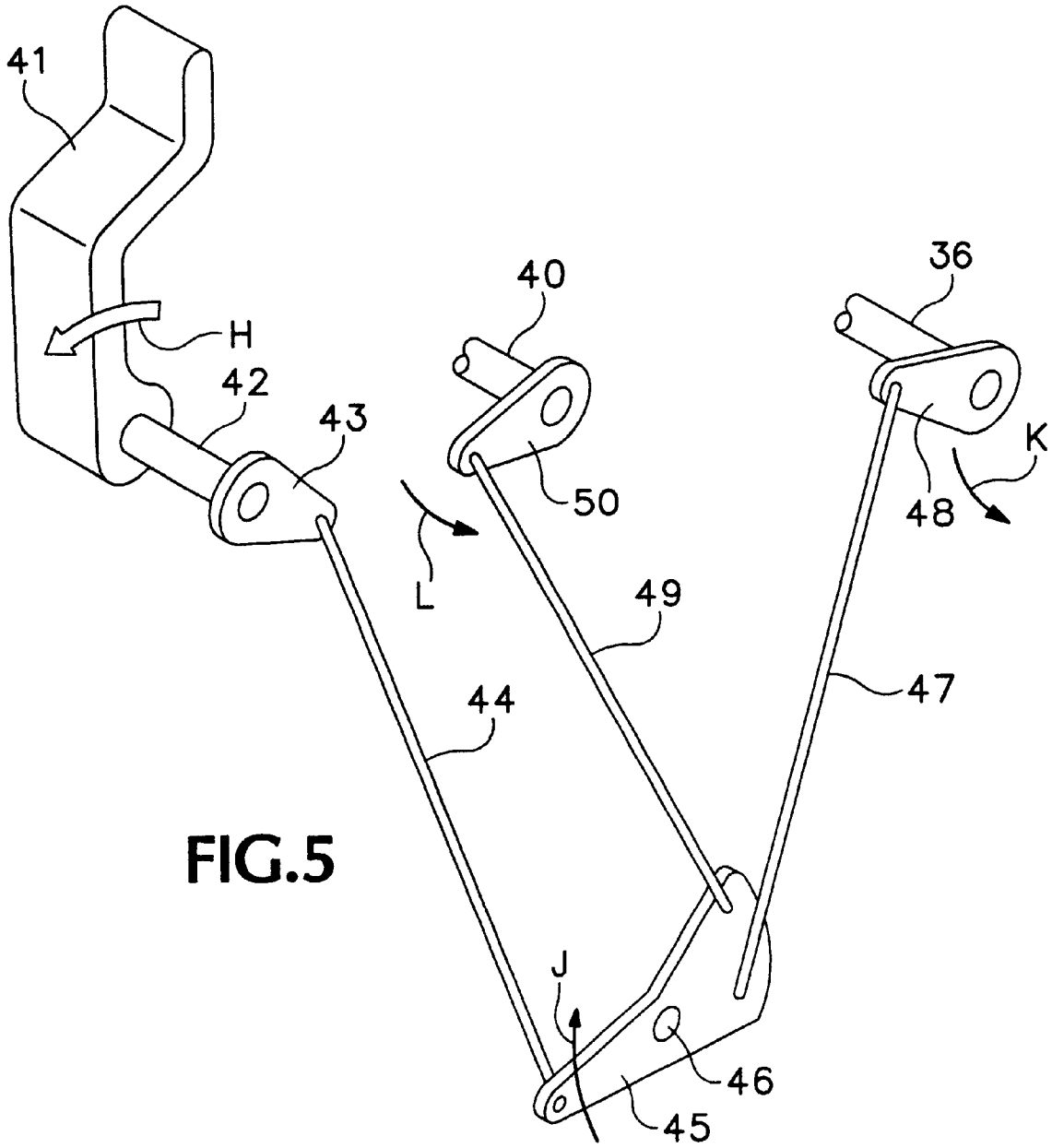
FIG. 5 is a perspective view showing a coupling relation among a control lever, a cam shaft and a spur shaft.

FIG. 5 is a view looking toward the control lever 41, etc. at the right hand of the paper surface of FIG. 2. In FIG. 5, there are omitted changeover elements, rotating cams, etc. referred to in the present invention.

Figure 7:
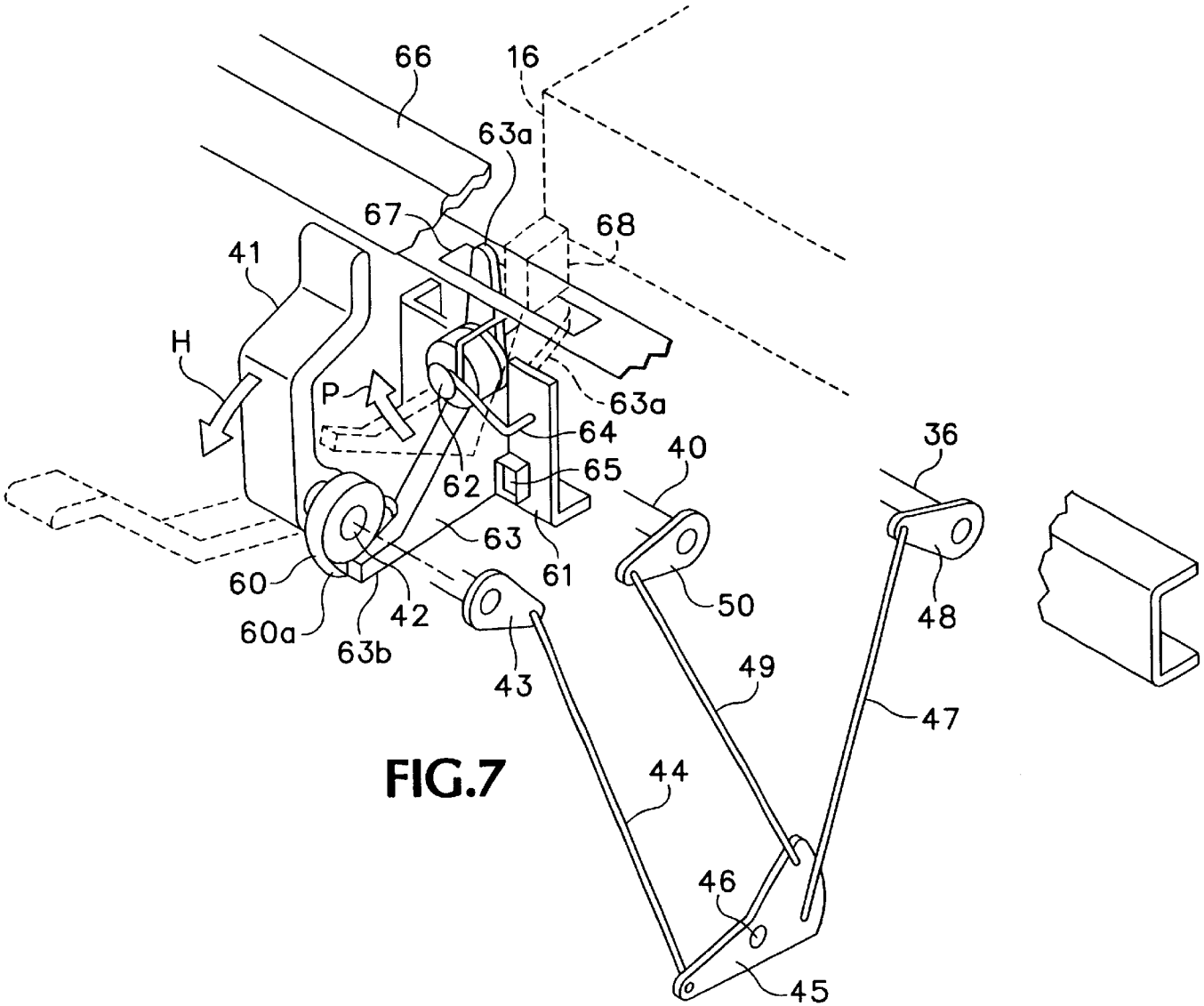
FIG. 7 is a perspective view showing a changeover cam, a control lever, etc.
Figure 8:
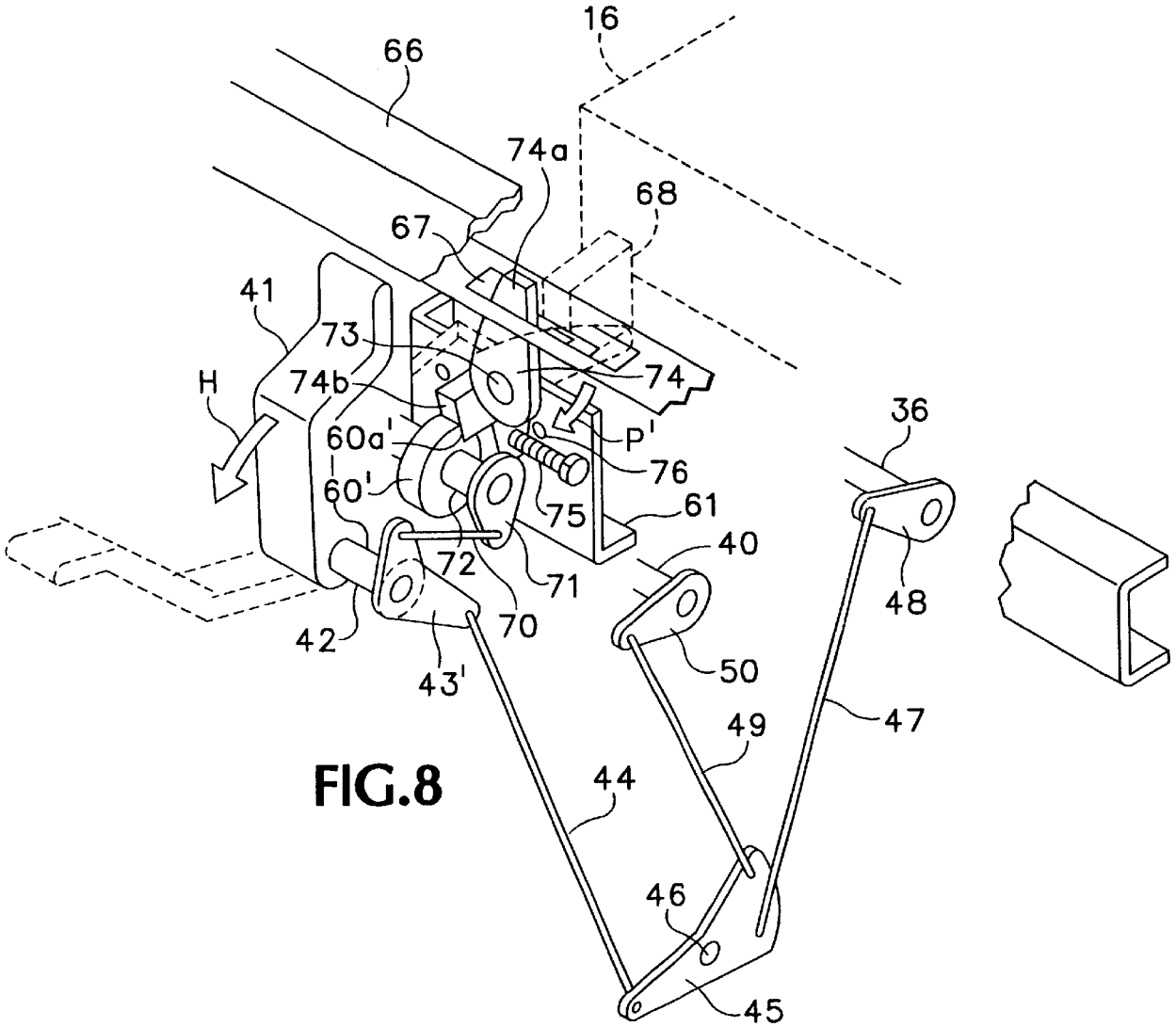
FIG. 8 is a perspective view showing another example of a changeover cam, a control lever, etc.

The changeover elements, rotating cams, etc. will be explained with reference to FIGS. 7 and 8.

When the control lever 41 rotates in the arrow H direction, a control lever shaft 42 fixed on the control lever 41 and a lever 43 fixed on the control lever shaft 42 also rotate in the same direction (the arrow H direction). A first coupling rod 44 coupled with the lever 43 is coupled with a transfer lever 45. The transfer lever 45 is fixed on a pivotal basis on a transfer shaft 46. Thus, when the control lever 41 rotates in the arrow H direction, the transfer lever 45 rotates in an arrow J direction. A second coupling rod 47 coupled with the transfer lever 45 is coupled with a cam lever 48 so as to rotate the cam shaft 36 in an arrow K direction. When the cam shaft 36 rotates in the arrow K direction, the cam shaft 36 rotates in the arrow F direction (cf. FIG. 3). Thus, as explained with reference to FIG. 3, the sheet conveyance rollers 10*a* and 10*b* separate from the drive roller 12 by the cam 37.

A third coupling rod 49 is coupled with the transfer lever 45. A spur lever 50 is coupled with the third coupling rod 49. The spur lever 50 is fixed on the spur shaft 40. The spur shaft 40 rotates in an arrow L direction in cooperation with the rotation of the control lever 41 in the arrow H direction. This causes the spur plate 21, which the spur 22 is fixed on, to rotate in the arrow G direction (cf.

Figure 3:
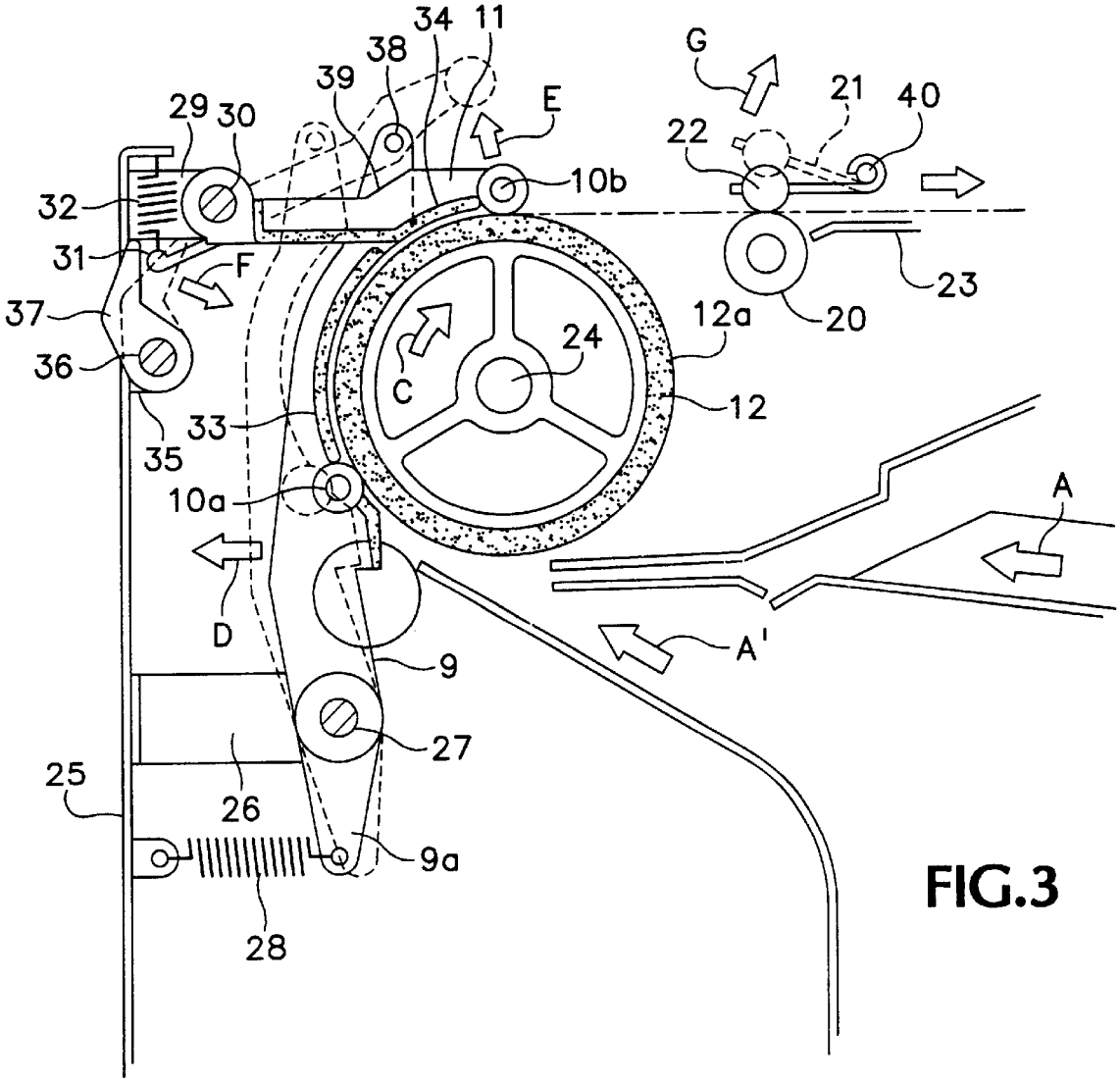
FIG. 3 is an explanatory view showing the periphery of the drive roller of the color plotter shown in FIG. 1.

FIG. 3), so that the spur 22 is separated from the discharge roller. Here, the above-mentioned lower conveyance shaft 30, cam shaft 36, spur shaft 40, etc. constitute the separation element referred to in the present invention.

As explained above, when the cam 37 rotates in the arrow F direction, the sheet conveyance rollers 10*a* and 10*b*, the guide elements 33 and 34, etc. rotate on the lower conveyance shaft 27 and the upper conveyance shaft 30, respectively, which are located at places apart from the drive roller 12, so that they separate from the drive roller 12. Thus, it is possible to readily process the jam occurred around the drive roller 12. Further, even if a jam occurs on a recording sheet conveyed at the downward stream end with respect to the recording sheet conveyance direction as compared with the drive roller 12, the spur plate 21 faces the upward stream end with respect to the recording sheet conveyance direction and opens in synchronism with the sheet conveyance rollers 10*a* and 10*b*, etc. Thus, it is possible to more readily process the jam.

In the above description, while there has been explained an arrangement for various types of coupling rods 44, 47 and 49 taking the transfer lever 45 as a main part, it is noted that the various types of coupling rods and their arrangement are determined by internal equipments of the plotter 1 and their arrangement, and their operational directions and their operational distances, etc. Here, for the purpose of making it easy to understand those operations, the structure is simplified. It is noted, however, that not only the more complicated structure, but also the more simplified structure are within the range of the present invention.

Next, referring to FIG. 6, there will be explained another structure for separating the sheet conveyance rollers 10*a* and 10*b* from the drive roller 12.

Figure 6:
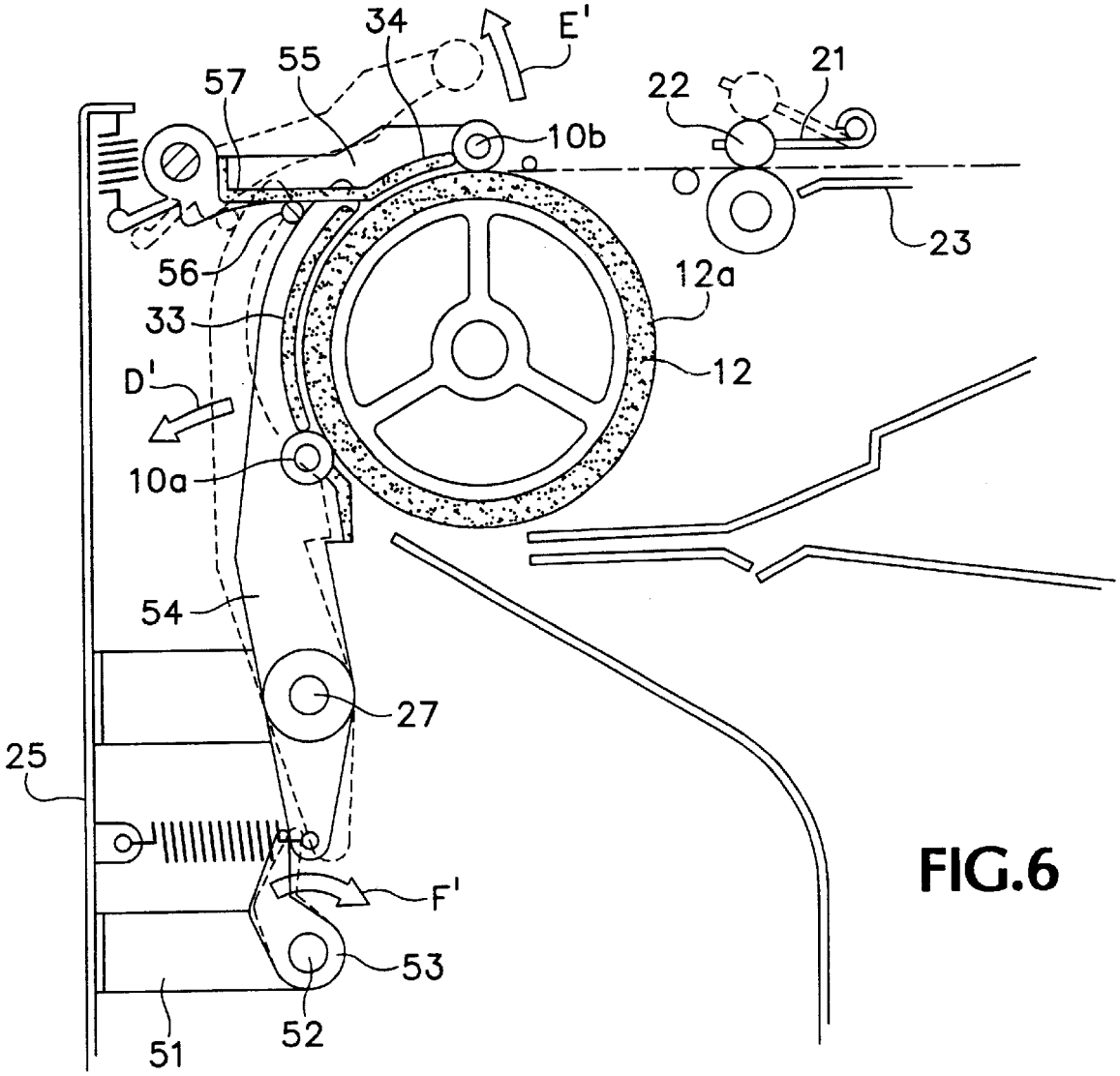
FIG. 6 is an explanatory view, showing the periphery of the drive roller, useful for understanding another structure for separating the sheet conveyance rollers from the drive roller.

With respect to FIG. 6, there will be mainly explained points which are different from the structure shown in FIG. 3. In FIG. 6, the same parts are denoted by the same reference numbers as those of FIG. 3.

In FIG. 3, there has been explained an arrangement in which the cam 37 is rotated to rotate the upper conveyance roller supporting plate 11, so that the sheet conveyance rollers 10*a* and 10*b* are separated from the drive roller 12. On the other hand, in FIG. 6, there will be explained an arrangement in which a cam 53 is rotated to rotate a lower conveyance roller supporting plate 54, so that the sheet conveyance rollers 10*a* and 10*b* are separated from the drive roller 12. Here, there will be explained by way of example, a processing in a case where a jam occurred.

A cam shaft mounting plate 51 is fixed on the main frame 25. A cam shaft 52 is rotatably fixed on the cam shaft mounting plate 51. A cam 53, which rotates in one united body together with the cam shaft 52, is fixed on the cam shaft 52. As the cam 53 rotates in an arrow F' direction, the lower conveyance roller supporting plate 54 rotates in the arrow D' direction on the lower conveyance shaft 27, so that the sheet conveyance roller 10*a* is separated from the drive roller 12.

A slide cam shaft 56 is formed on the upper end portion of the lower conveyance roller supporting plate 54. The slide cam shaft 56 moves, while it is in contact with a slide cam 57 to be pressed thereby. Thus, the upper conveyance roller supporting plate 54 rotates in the arrow E' direction. In this manner, when the control lever 41 (cf. FIG. 2) rotates and the cam 53 rotates in the arrow F' direction, the sheet conveyance roller 10*a* fixed on the lower conveyance roller supporting plate 54 and the sheet conveyance roller 10*b* fixed on the upper conveyance roller supporting plate 55 are separated from the drive roller 12. Thus, it is possible to readily process the jam occurred around the drive roller 12.

Further, in a similar fashion to that of FIG. 3, even if a jam occurs on a recording sheet conveyed at the downward stream end with respect to the recording sheet conveyance direction as compared with the drive roller 12, the spur plate 21 faces the upward stream end with respect to the recording sheet conveyance direction and opens in synchronism with the sheet conveyance rollers 10*a* and 10*b*, etc. Thus, it is possible to more readily process the jam.

Next, referring to FIG. 7 there will be explained a changeover element, and a rotary cam fixed on the control lever. In FIG. 7, the same parts are denoted by the-same reference numbers as those of FIG. 5.

A control lever shaft 42, which rotates together with the control lever 41, is fixed on the the control lever 41. A rotary cam 60, which rotates together with the control lever shaft 42, is fixed on the control lever shaft 42. Consequently, when the control lever 41 rotates in the arrow H direction, the rotary cam 60 also rotates in the arrow H direction.

A cam plate 61 is fixed on the main frame 25 (cf. FIG. 3) of the plotter 1 (cf. FIG. 1). A cam shaft 62, which is rotatable in an arrow P direction and the opposite direction, is fixed on the cam plate 61. A changeover cam 63 (an example of the changeover element referred to in the present invention), which rotates together with the cam shaft 62, is fixed on the cam shaft 62. The changeover cam 63 is actuated by a torsion coil spring 64 in the opposite direction to the arrow P direction. A stopper 65 is formed on the cam plate 61 in such a manner that the changeover cam 63 is in contact with the stopper 65 to control the rotation of the changeover cam 63.

In the plotter 1, there is provided an auxiliary rail 66 for guiding a reciprocation of the carriage 16. In the portion, which is located at the home position, of the auxiliary rail 66, there is provided a cut-out 67 which the top 63*a* of the changeover cam 63 penetrates. On the other hand, the bottom 63*b* of the changeover cam 63 is in contact with a contact element 60*a* of the rotary cam 60 to prohibit the rotation of the rotary cam 60. For this reason, when the bottom 63*b* of the changeover cam 63 is in contact with the contact element 60*a* of the rotary cam 60, the control lever 41 cannot rotate in the arrow H direction.

When the carriage 16 is translated to the home position, a cam 68 formed on the carriage 16 pushes the top 63*a* of the changeover cam 63 down. As a result, the changeover cam 63 rotates on the cam shaft 62 in an arrow P direction, so that the bottom 63*b* of the changeover cam 63 separates from the rotary cam 60. Thus, the control lever 41 can rotate in the arrow H direction, and whereby the sheet conveyance rollers 10*a* and 10*b* are separated from the drive roller 12, and in addition the spur 22 separates from the discharge roller 20. Accordingly, it is possible to remove the recording sheet subjected to the jam.

In this manner, according to the present embodiment. only when the carriage 16 is located at the home position, it is permitted that the control lever 41 rotates in the arrow H direction, whereby the sheet conveyance rollers 10*a* and 10*b*, and the spur 22, as shown in FIG. 3 are moved. On the other hand, when the carriage 16 is located at places near the image forming area other than the home position, it is not permitted that the control lever 41 rotates in the arrow H direction. Accordingly, when the processing for the jam is performed, it is possible to prevent the carriage and the print head from being damaged by the sheet conveyance rollers 10*a* and 10*b*, and the spur 22.

Next, referring to FIG. 8 there will be explained another example of a changeover cam, and a rotary cam. In FIG. 8, the same parts are denoted by the same reference numbers as those of FIG. 5 and FIG. 7.

A control lever shaft 42, which rotates together with the control lever 41, is fixed on the the control lever 41. A lever 43', which rotates together with the control lever shaft 42, is fixed on the control lever shaft 42. Consequently, when the control lever 41 rotates in the arrow H direction, the lever 43' also rotates in the arrow H direction. Further, a lever shaft 72 is rotatably mounted on the main frame 25 (cf. FIG. 3). A rotary cam 60' and a lever 71 are fixed on the lever shaft 72. The lever 43' and the lever 71 are coupled with each other through the fourth coupling rod 70.

A cam plate 61 is fixed on the main frame 25. A cam shaft 73, which is rotatable in an arrow P' direction and the opposite direction, is fixed on the cam plate 61. A changeover cam 74 (an example of the changeover element referred to in the present invention), which rotates together with the cam shaft 73, is fixed on the cam shaft 73. The changeover cam 74 is actuated by a spring 75 in the opposite direction to the arrow P' direction. A stopper 76 is formed on the cam plate 61 in such a manner that the changeover cam 74 is in contact with the stopper 76 to control the rotation of the changeover cam 74.

In the plotter 1, there is provided the auxiliary rail 66. In the portion, which is located at the home position, of the auxiliary rail 66, there is provided the cut-out 67 which the top 74*a* of the changeover cam 74 penetrates. On the other hand, the bottom 74*b* of the changeover cam 74 is in contact with a contact element 60*a* of the rotary cam 60' to prohibit the rotation of the rotary cam 60'. For this reason, when the bottom 74*b* of the changeover cam 74 is in contact with the contact element 60' a of the rotary cam 60, the control lever 41 cannot rotate in the arrow H direction.

When the carriage 16 is translated to the home position, the cam 68 formed on the carriage 16 pushes the top 74*a* of the changeover cam 74 down. As a result, the changeover cam 74 rotates on the cam shaft 73 in an arrow P direction, so that the bottom 74*b* of the changeover cam 74 separates from the rotary cam 60'. Thus, the control lever 41 can rotate in the arrow H direction, and whereby the sheet conveyance rollers 10*a* and 10*b* shown in FIG. 3 are separated from the drive roller 12, and in addition the spur 22 separates from the discharge roller 20. Accordingly, it is possible to remove the recording sheet subjected to the jam.

In this manner, according to the present embodiment, only when the carriage 16 is located at the home position, it is permitted that the control lever 41 rotates in the arrow H direction, whereby the sheet conveyance rollers 10*a* and 10*b*, and the spur 22, as shown in FIG. 3 are moved. On the other hand, when the carriage 16 is located at places near the image forming area other than the home position, it is not permitted that the control lever 41 rotates in the arrow H direction. Accordingly, when the processing for the jam is performed, it is possible to prevent the carriage and the print head from being damaged by the sheet conveyance rollers 10*a* and 10*b*, and the spur 22.

Incidentally, according to the present embodiment, only when the carriage is located at the home position, it is permitted that the control lever rotates by the changeover element. It is noted, however, that it is acceptable so arranged that when the carriage is located at positions other than an interference area, at which positions the carriage does not collide with the separated conveyance roller and the like, without restricting the position of the carriage to the home position, the control lever is permitted in its rotation. Further, according to the present embodiment, the present invention is applied to an image forming apparatus employing an ink-jet system. It is noted, however, that the present invention may be applied to a pen type of image forming apparatus.

Industrial Applicability

As explained above, according to the first image forming apparatus of the present invention, when the control lever is rotated, the driven roller rotates on the first shaft extending in parallel to the drive roller axle at a location apart from the drive roller, so that the driven rollers separate from the outer peripheral surface of the drive roller, and the driven discharge roller rotates on the second shaft extending in parallel to the drive roller axle at a location apart from the drive roller, so that the driven discharge roller separates from the outer peripheral surface of the discharge roller. This feature makes it possible not only to readily perform a processing for the jam, but also to immediately put the driven rollers, which are separated from the drive roller, back in their places.

Here, in the event that the driven roller comprises a first driven roller and a second driven roller, wherein there are provided a first lever and a second lever, and the first shaft comprises a first lever shaft and a second lever shaft, it is possible to effectively attach and detach the first and second driven rollers on and from the outer peripheral surface of the drive roller.

Further, in the event that the first lever is rotatable in the first detachable direction in cooperation with the rotation of the control lever, and the second lever is rotatable in the second detachable direction in cooperation with the rotation of the first, it is possible to more effectively attach and detach the first and second driven rollers on and from the outer peripheral surface of the drive roller.

Furthermore, in the event that the second shaft is arranged at the downward stream end with respect to the recording sheet conveyance direction as compared with the driven discharge roller, it is possible to more readily perform the jam processing, since it is permitted that the recording sheet is taken out from the upward stream end with ale respect to the recording sheet conveyance direction.

According to the second image forming apparatus of the present invention, the first and second levers come close to the outer peripheral surface of the drive roller so that the first and second driven rollers press the outer peripheral surface, and the drive roller and the first and second driven rollers support and convey a recording sheet. When a jam occurs, the control lever is rotated to rotate the second lever so that the second driven roller is separated from the outer peripheral surface of the drive roller. In this manner, the slide cam of the second lever presses the slide cam shaft of the first lever, so that the first driven roller is also separated from the outer peripheral surface of the drive roller. Thus, simply rotating the control lever permits the first and second driven rollers to separate from the outer peripheral surface of the drive roller. This feature makes it possible to readily take out the recording sheet subjected to the jam. After the recording sheet subjected to the jam is removed, in order to convey again the recording sheet, the first and second levers are rotated to press the outer peripheral surface of the drive roller with the first and second driven rollers. Therefore, it is possible to readily return to the state in which the recording sheet can be conveyed.

Further, the first and second levers extend along the X axis and the Y axis, which perpendicularly intersect one another, respectively, and rotate on the first and second lever shafts separated from the drive roller. This feature makes it possible, even if a jam occurs, to more readily remove a recording sheet subjected to the jam, and also possible to immediately put the first and second driven rollers, which are separated from the drive roller, back in their places.

According to the third image forming apparatus of the present invention, when the print element is located at the interference area, the changeover element prohibits the control lever from rotating, and as a result, it is impossible to separate a pair of conveyance rollers from one another. On the other hand, when the print element is not located at the interference area, the changeover element permits the control lever to rotate, and as a result, it is possible to separate a pair of conveyance rollers from one another. Thus, when a processing for the jam is performed, it is possible to prevent the print element from being damaged by the separated conveyance roller and the like.

Here, in the event-that a rotating cam, which rotates in cooperation with the control lever, is provided, wherein when the print element is located at the home position. separated from the image forming area, the changeover element permits the control lever to rotate by separating from the rotating cam, and on the other hand, when the print element is located in the vicinity of the image forming area, the changeover element prohibits the control lever from rotating through being in contact with the rotating cam, it is possible to more reliably prevent the print element from being damaged with a relatively simple structure.

Further, in the event that there are provided a control lever shaft which is rotatable together with the control lever, and a lever shaft on which the rotating cam is fixed, the lever shaft being coupled with the control lever shaft and being rotatable together with the control lever shaft, it is possible to optionally select a position for an arrangement of the control lever.

What is claimed is:

1. An image forming apparatus having a print member for forming an image on a recording sheet while reciprocating in a predetermined direction, and a pair of conveyance rollers for supporting and conveying recording sheets in a direction intersecting said predetermined direction, wherein said pair of conveyance rollers are used to convey a recording sheet to an image forming area for an image formation within a range of a reciprocation of said print member, and an image is formed on the recording sheet by said print member, said image forming apparatus comprises:

a separating member for separating said pair of conveyance rollers from one another;

a control lever for controlling said separating member through rotating in a predetermined rotational direction so that said pair of conveyance rollers are separated from one another; and a changeover element for permitting said control lever to rotate when said print member moves in the predetermined direction and is not located at an interference area in which said print member collides with the conveyance rollers separated by said separating member, and for prohibiting said control lever from rotating when said print member is located at the interference area.

2. An image forming apparatus having a print member for forming an image on a recording sheet while reciprocating in a predetermined direction, and at least one pair of conveyance rollers for supporting and conveying recording sheets in a direction intersecting said predetermined direction, wherein said at least one pair of conveyance rollers are used to convey a recording sheet to an image forming area for an image formation within a range of a reciprocation of said print member, and an image is formed on the recording sheet by said print member, said image forming apparatus comprises:

a separating member for separating said at least one pair of conveyance rollers from one another;

a control lever for controlling said separating member through rotating in a predetermined rotational direction so that said pair of conveyance rollers are separated from one another; and a changeover element for permitting said control lever to rotate when said print member moves in the predetermined direction and is not located at an interference area in which said print member collides with the conveyance rollers separated by said separating member, and for prohibiting said control lever from rotating when said print member is located at the interference area, further comprising a rotary cam rotatable together with said control lever, wherein said changeover element permits said control lever to rotate by separating from said rotary cam when said print member is located at a home position away from said image forming area, and for prohibiting said control lever from rotating by being in contact with said rotary cam.

3. An image forming apparatus according to claim 2, further comprising a control lever shaft rotatable together with said control lever, and a lever shaft on which said rotary cam is fixed, said lever shaft being coupled with said control lever shaft and rotatable together with said control lever shaft.

* * * * *